United States Patent [19]

Thiel

[11] Patent Number: 4,922,848

[45] Date of Patent: May 8, 1990

[54] UNDERWATER RESCUE DEVICE

[76] Inventor: Michael R. Thiel, 2301 Pasadena Ave., Apt. C, Metairie, La. 70001

[21] Appl. No.: 221,504

[22] Filed: Jul. 18, 1988

[51] Int. Cl.[6] ..... B63G 8/36

[52] U.S. Cl. ..... 114/334; 239/271

[58] Field of Search ..... 114/44, 49, 50, 52, 114/53, 334, 336; 239/271; 227/9, 27

[56] References Cited

U.S. PATENT DOCUMENTS

| | | | |
|---|---|---|---|
| 1,775,595 | 9/1930 | Lieske | 114/334 |
| 2,355,513 | 8/1944 | Cox | 114/334 |
| 4,106,701 | 8/1978 | Siefken | 239/271 |
| 4,284,110 | 8/1981 | Divelbiss et al. | 114/50 |

*Primary Examiner*—Joseph F. Peters, Jr.
*Assistant Examiner*—Jesûs D. Sotelo
*Attorney, Agent, or Firm*—Keaty & Keaty

[57] ABSTRACT

An underwater rescue device which delivers fresh air into the interior of a submerged vessel by puncturing a hole through the body of the vessel and forcing fresh air through the new opening. The rescue device provides for the use of an elongated housing having an internal passageway which utilizes a means for puncturing an aperture into the body of a submerged vessel. The means for puncturing an aperture may take the form of a dart which is projected by a sliding weight hammer through the body of the vessel. Once an opening is made into the body of the vessel, air is supplied through the internal passageway through the opening into the vessel. The device further provides a sealing member for the created opening for use during the delivery of fresh air.

17 Claims, 2 Drawing Sheets

UNDERWATER RESCUE DEVICE

BACKGROUND OF THE INVENTION

This invention relates to an underwater rescue device designed to allow a rescuer to deliver air in a life threatening situation to a submerged boat, airplane, automobile, or other submerged vessels. There exists a great need for a convenient portable tool that can puncture aluminum, sheet metal, plexiglass, plastic or other material making up the body of a vessel or vehicle and that can be connected conveniently to an air supply, so that air can be delivered rapidly to the interior of the vehicle or vessel.

Sometimes, as a result of an accident, a car rolls into the river or other body of water and submerges, threatening passengers and drivers underwater with a limited amount of air present in the interior of the car. Sometimes, a boat sinks, and even though it is water tight, it also traps persons on the boat within the sealed area with a limited amount of air for breathing.

Under such circumstances, it is the utmost important to deliver air into the submerged vehicle at the earliest possible time. However, a rescue operation involving retrieval of the submerged vehicle may take some time and the trapped persons do not survive for such time. Therefore, it is necessary to provide a tool which can puncture a wall of the submerged vessel and introduce fresh air into the interior of the vessel and save lives before necessary equipment for retrieving the submerged vehicle can arrive at the scene of the accident. Such device must be portable and easily connectable to a portable air supply, such as for example, an air tank of a scuba diver so that the divers who first arrived at the scene have a chance to save lives prior to application of complicated equipment.

Sometimes, the air needs to be delivered into the submerged vessel to simply make it buoyant so that it can float up to the surface of the water with the help of the sufficient amount of air delivered into the interior of the submerged vessel.

It is therefore an object of this invention to provide a portable device for delivery of air into an interior of a submerged vehicle or allow the occupants to breathe or to float the submerged object up to the surface.

It is a further object of this invention to provide a rescue tool that can be connected easily to conventional scuba air tanks.

These and other objects of the present invention will be more apparent from the following description of the invention.

SUMMARY OF THE INVENTION

The rescue device provides for the use of an elongated shaft or a housing having an internal passageway extending through at least a portion thereof. A puncture element, in the form of a dart, or a cone-shaped tip is fixedly secured on one end of the shaft and is provided with openings in fluid communication with the internal passageway of the housing. Air striking force on the puncture element can be applied by a sliding weight hammer having a pair of stops securedly positioned on the body of the shaft a distance from the puncture tip. The internal passageway adapted for connection to an air supply, which air travels through the internal passageway and out of the openings is made in the puncture element, which is designed to penetrate into the body of the submerged vehicle so that air outlet openings appear in the interior of the submerged housing or vessel.

A deformable sealing member is moved along the elongated shaft towards the created puncture, the sealing member being co-axially mounted on the shaft. A non-deformable ring pushes the sealing member towards the puncture element and secures its sealing position in relation to the puncture area during delivery of air. A handle attached to the housing allows easy handling of the rescue device during operation.

DETAILED DESCRIPTION OF THE PREFERRED EMBODIMENT

Figures 1, 2, 3, 4, 5, 6, 7, 8:
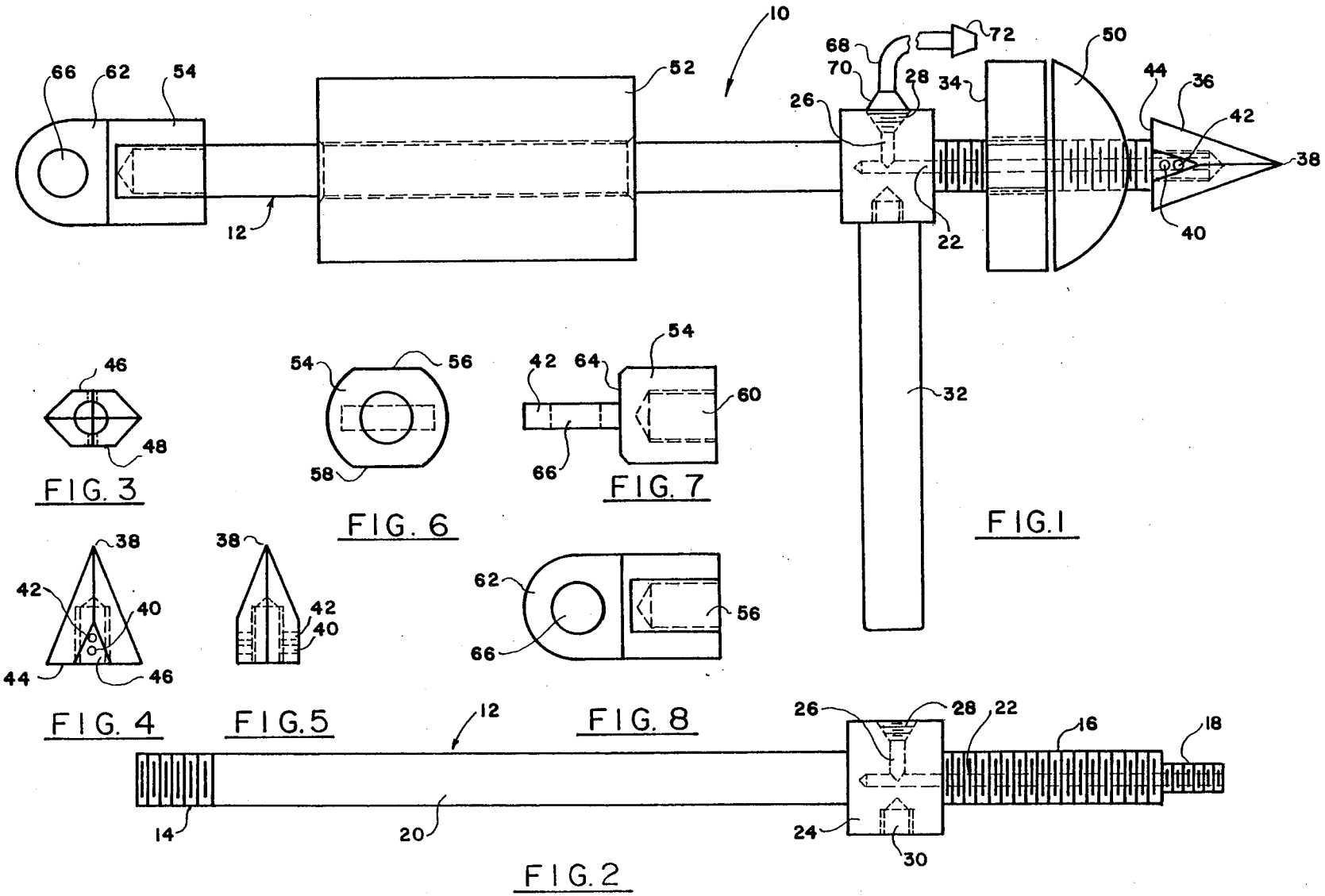
FIG. 1 is a side plan view of the apparatus in accordance with the present invention.
FIG. 2 is a side plan view of an elongated shaft of the tool shown in FIG. 1.
FIG. 3 is a top plan view of the puncture element.
FIG. 4 is a side view of the element shown in FIG. 3.
FIG. 5 is an end view of the element shown in FIGS. 3 and 4.
FIG. 6 is a top plan view of the outer stop element.
FIG. 7 is an end view of the element shown in FIG. 6.
FIG. 8 is a side view of the element shown in FIGS. 6 and 7.
Figures 9, 10:
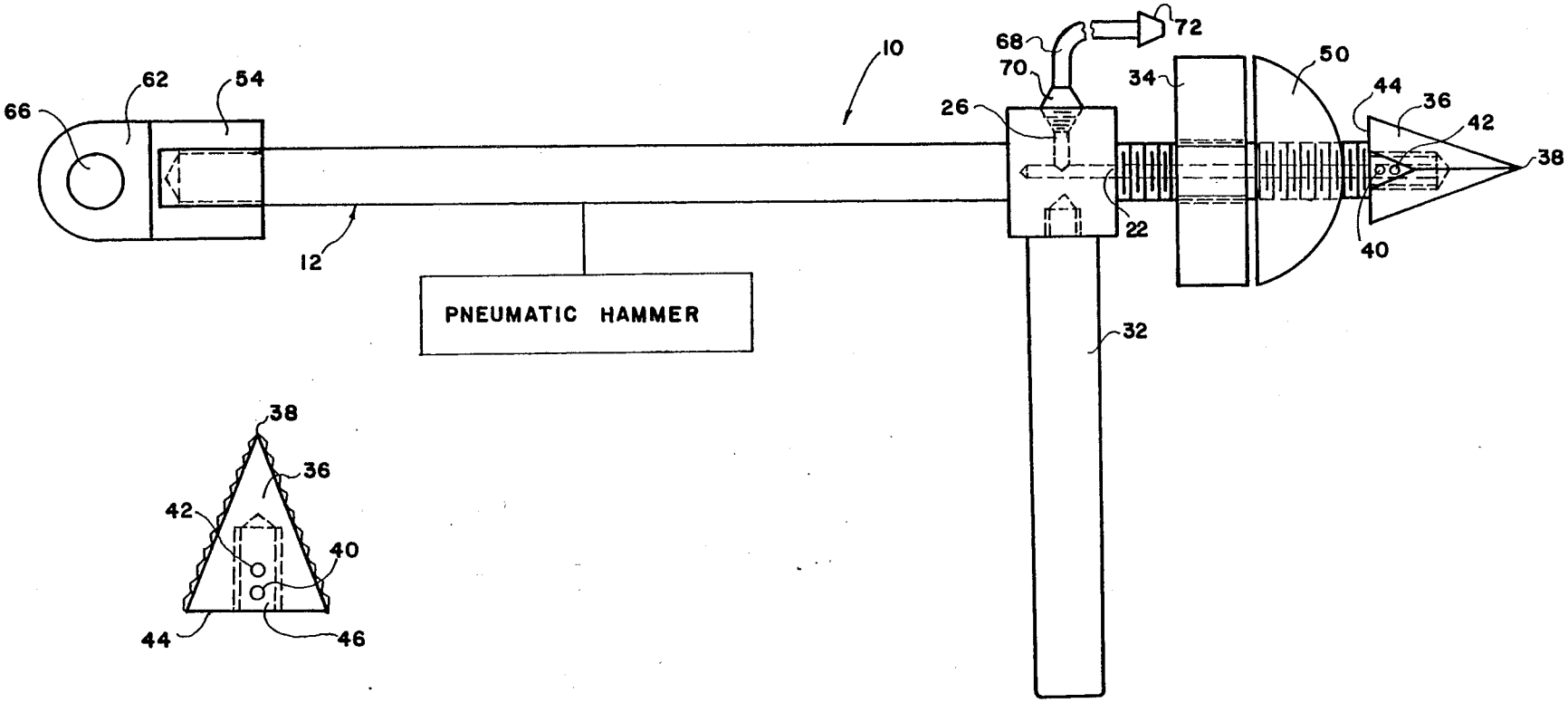

Referring to the drawings, the apparatus of the present invention is generally designated by numeral 10. The tool 10 comprises an elongated shaft or housing 12 having an externally threaded end 14 and externally threaded end 16.

The end 16, at its outermost end has a reduced diameter portion, designated by numeral 18 in the drawings, which is externally threaded through its entire length. The middle portion 20 of the shaft 12 has a smooth outer exterior, the purpose of which will be explained hereinafter.

Extending axially through the portion 16 of the shaft 12 is an internal passageway 22, which terminates adjacent the middle portion 20 at one of its ends and extends throughout the part 18 at its other end.

Co-axially attached to the shaft 12 is a reinforcement sleeve 24, which reinforces the area of inner passageways 22 and 26.

Passageway 26 extends perpendicularly to the passageway 22 through the body of the reinforcement sleeve 24 and has an interiorly threaded portion 28 for connecting to an air supply hose. A diametrically opposite end of the reinforcement sleeve 24 is provided with an internally threaded aperture 30 which receives an externally threaded end of a handle 32.

The handle 32 is designed to extend perpendicularly to a longitudinal axis of the shaft 12 to provide for an ease of handling of the tool 10.

Threadably mounted on the portion 16 of the shaft 12 is a seal securing ring 34 which has an external diameter substantially greater than the diameter of the shaft 12.

A puncturing element 36 is adapted for threadable attachment to the part 18 through the mating internal threads made in the element 36. The element 36 has a pointed end 38 designed to puncture a hole in a body of a submerged vessel, as will be explained in more detail below.

A pair of vertically spaced apertures 40 and 42 are made in the body of the puncturing element 36, the apertures extending substantially through entire width of the element 36 and allowing fluid communication between passageway 22 of the shaft 12 and exterior of the element 36.

As can be seen in FIG. 3, the puncturing element 36 has a hexagonal cross section at its innermost end 44, and a pair of flat faces 46 and 48 are formed to accommodate apertures 40 and 42 vertically spaced from each other. It will be appreciated that the number of apertures can be varied, as well as the diameter of the apertures and their relative position. It is important, however, that the apertures communicate with the passageway formed in the shaft 12 of the tool 10.

Fitted between the ring 34 and puncturing element 36 is a sealing element 50 which has an internal opening extending substantially through its entire width of a diameter slightly greater than the diameter of the shaft 12. The sealing element is adapted to slide, under the force applied by the ring 34, in the direction of the element 36 and bear against the end 44, when needed. The sealing element 50 is made of a flexible deformable material, such as polymer or rubber, suitable for sealing of an area, wherein a puncture was made through the use of the tool 10.

A sliding weight hammer 52, in the form of a cylindrical sleeve is co-axially slidably mounted on the portion 20 of the shaft 12 and adapted for sliding movement between the reinforcement sleeve 24 and an outer stop limit element 54.

An interior central opening extending through the length of the sliding weight hammer 52 allows sliding of the hammer along the shaft 12 in the direction of the puncture element 36 and away from it.

The outer stop limit element 54 has a generally circular cross section with a pair of flat faces 56 and 58. Extending through at least a part of the element 54 is an interiorly threaded opening 60 which has the threads matching the threads of the portion 14 of the shaft 12. In this manner, the stop element can be mounted on the shaft 12 and fixedly attached thereto. The stop element 54 is provided with a suspension means 62, rigidly attached to outermost end 64 of the stop element 54 allowing suspension of the tool 10 by suitable suspension means. In order to facilitate the suspension, an aperture 66 is made in the portion 62.

In operation, the tool 10 is manually operated, allowing an operator to hold the tool 10 by the handle 32, while effecting striking blows by the sliding weight hammer 52 on the reinforcement sleeve 24. The tip 38 of the puncture element 36 punctures a hole in a body of a submerged vessel, and the operator continues the hammering action until substantially entire puncture element 36 penetrates through the body of the vessel so that the apertures 40 and 42 appear in the interior of the submerged vessel. Once the appropriate punctured hole is made, the hammering action is terminated and the ring 34 is rotated for movement along the shaft portion 16 in the direction of the just punctured wall of the vessel, thus forcing the sealing element 50 to move into frictional engagement with the exterior side of the wall of the vessel and seal the area of the puncture, forming a water and air tight seal around the edges of the punctured hole.

The hammer element 52 is prevented from sliding off of the shaft 12 through the use of the outer stop limit element 54.

An air supply hose 68 having a coupler 70 provided with the matching threads is inserted into the aperture 28 and threadably engaged with the wall of portion 28. Once the hole is sealed, a standard attachment 72 on the opposite end of the hose 68 allows connection of the hose 68 to a conventional scuba air tank or other suitable air source for delivery of air through the holes into the passage 26 and from there into the passage 22. The air travelling through the passage 22 escapes through the apertures 40 and 42 and into the interior of the submerged vessel, thus delivering the badly needed supply of air.

It should be noted that additional sealing action can be provided with the use of the punctured element 36 which, after the hole has been punctured, is turned 90° around its axis, turning it sideways and preventing the puncture element 36 from sliding out from the just made hole. The face 44 bears against the interior wall of the submerged vessel and insures further water and air tight seal in the area of the punctured hole.

Alternatively, the sliding weight hammer 52 may be substituted by a conventional hydraulic hammer. In that case, the outer stop element 54 may be substituted by special adapter to allow the use of a pneumatic hammer.

In still another embodiment, a drill bit may be substituted for the puncture element 36 and the shaft 12 is suitably adapted for connection to a conventional torque application means.

Still another embodiment provides for the use of a cone-shaped element 36 with self-sealing outer threads, allowing sealing of the area around the punctured hole with the use of the punctured element 36.

The material from which the tool 10 is manufactured is preferably non-corrosive, while the material used for the element 36 should be strong enough to withstand the impact applied by the sliding or pneumatic hammer and capable of puncturing a suitable hole in a metal, plexiglass or other wall of the submerged vessel.

Many other modifications can be made in the preferred embodiment of the present invention described herein without departing from the scope and spirit thereof. Thus, the present description is intended for illustrative purposes only and not for the purpose of limitation.

I, therefore, pray that my rights to the present invention be limited only by the scope of the appended claims.

I claim:

1. A device for delivering air to a submerged vessel, comprising:

an elongated housing carrying a sealing member of deformable flexible material, the housing having an internal passageway;

means for puncturing an aperture in a body of said vessel, said means being in fluid communication with the internal passageway of said elongated housing;

means for moving said sealing member along said elongated housing toward said puncturing means; and means for delivering air through said housing and through said puncturing means into the interior of said vessel.

2. The apparatus of claim 1, wherein said means for delivering air comprises a tube connectable for fluid communication with the internal passageway of said elongated housing at one of its ends and connectable to an air supply at its other end.

3. A device for delivering air to a submerged vessel, comprising:

an elongated housing having an internal passageway;

a puncturing element having a sharpened end and at least one aperture in fluid communication with the internal passageway of said housing;

means for imposing a striking force on said puncturing element to effect a puncture in a body of the submerged vessel and allow at least a part of said puncturing element having said at least one aperture to penetrate into the interior of said vessel;

means for sealing said puncture comprising a sealing member of deformable flexible material carried by said elongated housing;

means for moving said sealing member along said elongated housing toward said puncturing element and retaining said sealing member in place, so that when the puncturing element penetrates into the submerged vessel, the sealing member is moved to seal the puncture; and means for delivering air through said housing and through said puncturing element into the interior of said vessel.

4. The apparatus of claim 3, wherein said means for imparting a striking force comprises a sliding weight hammer.

5. The apparatus of claim 3, wherein said means for imparting a striking force comprises a pneumatically-operated hammer.

6. The apparatus of claim 3, wherein said means for moving said sealing member comprises an annular member threadably connected to an exterior of said elongated housing.

7. The apparatus of claim 3, wherein said puncturing element is threadably connected to said elongated housing.

8. The apparatus of claim 3, wherein said puncturing element comprises a cone-shaped bit with external threads.

9. A portable device for delivering air to a submerged housing, comprising:

an elongated shaft carrying a sealing member of deformable flexible material, the shaft having an internal passageway extending through at least a portion of said shaft;

means for puncturing an aperture in a body of the submerged housing carried by one end of said shaft;

a means for moving said sealing member along said elongated shaft toward said puncturing means and retaining said sealing member in place, so that when the puncturing means penetrates into the submerged housing, the sealing member is moved to seal the puncture; and means for connecting said internal passageway to a source of air for delivery of air to an exterior of said shaft through an air outlet formed in the puncturing means.

10. The device of claim 9, wherein said means for puncturing an aperture comprise a puncture element having a pointed end and fixedly attached to said shaft and a means for imparting a striking force on said puncture element.

11. The device of claim 10, wherein said puncture element is provided with at least one aperture in fluid communication with the internal passageway and the exterior of said shaft.

12. The device of claim 10, wherein said means for imparting a striking force comprise a sliding weight hammer means mounted in co-axially sliding relationship on said elongated shaft.

13. The device of claim 12, comprising means for limiting sliding movement of said hammer means along said elongated shaft.

14. The device of claim 13, wherein said means for limiting the sliding movement comprise a reinforcement sleeve fixedly attached to said elongated shaft a distance from said puncture element and an outer stop limit member carried by an end of said shaft opposite said puncture element.

15. The device of claim 13 further comprising a reinforcement sleeve provided with an internal passageway, one end of which is adapted for connecting to an air supply means, said passageway being in fluid communication with the internal passageway of said shaft.

16. The device of claim 10, wherein said means for moving the sealing member comprise a non-deformable sealing member adapted for moving said sealing member along said shaft and retaining it in sealing engagement about the punctured aperture.

17. The device of claim 9, further comprising a handle means connectable to said shaft in substantially perpendicular relationship thereto.

* * * * *